United States Patent [19]

Pfistermeister et al.

[11] 4,141,759

[45] Feb. 27, 1979

[54] PROCESS FOR THE FORMATION OF AN ANTICORROSIVE, OXIDE LAYER ON MARAGING STEELS

[75] Inventors: Martin Pfistermeister, Düren-Gürzenich; Heinz Krapf, Selgersdorf; Erwin Coester, Julich, all of Fed. Rep. of Germany

[73] Assignee: URANIT Uran-Isotopentrennungs-Gesellschaft mbH, Julich, Fed. Rep. of Germany

[21] Appl. No.: 650,759

[22] Filed: Jan. 20, 1976

[30] Foreign Application Priority Data

Jan. 30, 1975 [DE] Fed. Rep. of Germany ..... 2503763

[51] Int. Cl.[2] ..... C23C 11/10; C23C 11/11

[52] U.S. Cl. ..... 148/6.35

[58] Field of Search ..... 427/399; 148/6.35

[56] References Cited

U.S. PATENT DOCUMENTS

| | | | |
|---|---|---|---|
| 501,705 | 7/1893 | Craig | 148/6.35 |
| 705,935 | 7/1902 | Lee et al. | 148/6.35 |
| 1,079,269 | 11/1913 | Seeger | 148/6.35 |
| 1,105,251 | 7/1914 | Carnahan | 148/6.35 |
| 1,346,473 | 7/1920 | Swan | 148/6.35 |
| 1,690,378 | 11/1928 | Rinck | 148/6.35 |
| 2,202,773 | 5/1940 | Given | 148/6.35 |
| 2,236,728 | 4/1941 | Given | 148/6.35 |
| 2,268,868 | 1/1942 | Given | 148/6.35 |
| 2,269,601 | 1/1942 | Perrin | 148/6.35 |
| 2,543,710 | 2/1951 | Schmidt et al. | 148/6.35 |
| 2,591,460 | 4/1952 | Morrill | 148/6.35 |
| 2,853,407 | 9/1958 | Rogers | 148/6.35 |
| 3,617,394 | 11/1971 | Mayer | 148/6.35 |
| 3,954,512 | 5/1976 | Kanter | 148/6.35 |
| 3,969,153 | 7/1976 | Suzuki et al. | 148/6.35 |

FOREIGN PATENT DOCUMENTS

| | | |
|---|---|---|
| 1621509 | 11/1971 | Fed. Rep. of Germany. |
| 1198650 | 7/1970 | United Kingdom. |
| 1283081 | 7/1972 | United Kingdom. |

OTHER PUBLICATIONS

Swann, B. R. Heat-Treatment in Steam, pp. 167–172, Apr., 1954.

*Primary Examiner*—Michael F. Esposito
*Assistant Examiner*—Sadie L. Childs
*Attorney, Agent, or Firm*—Spencer & Kaye

[57] ABSTRACT

A method is provided for forming an anti-corrosive, oxide layer on steel. The steel surface is subjected to superheated steam for a period of one to several hours. Before subjecting the steel to the superheated steam, a clean steel surface is initially heated to at least 200° C. in a nitrogen, air, or oxygen atmosphere. The treatment with superheated steam takes place during a further heating period in which a temperature between 450° C. and 520° C. is reached and maintained under steam flow through conditions in which the steam flow is turbulent or should have a Reynolds number greater than 900.

8 Claims, No Drawings

PROCESS FOR THE FORMATION OF AN ANTICORROSIVE, OXIDE LAYER ON MARAGING STEELS

BACKGROUND OF THE INVENTION

The present invention relates to a method for producing an anti-corrosive, oxide layer on steel, and more particulary, relates to a method in which the steel surface is subjected to superheated steam for a period of one to several hours.

A process for forming an anti-corrosive, oxide layer on steel by subjecting the steel surface to superheated steam is known from the German Auslegeschrift No. 1,621,509. According to this process, a corrosion preventing, protecting layer of $Fe_3O_4$ is formed by conducting superheated steam, of at least 250° C., through pipelines, apparatus and vessels of steam power plants. The protective layer formed in this manner, however, does not withstand all chemical influences. Furthermore, undesirable hydrogen embrittlement can occur when using this above mentioned method.

SUMMARY OF THE INVENTION

The primary object of the present invention is to provide a method to protect steel better than previously possible against the attack of very aggressive media without thereby impairing the mechanical properties of the steel.

A further object of the present invention is to provide a method to better protect steel against gases which have a strongly fluorinating effect, such as, for example, uranium hexafluoride.

Additional objectives and advantages of the present invention will be set forth, in part, in the description which follows and in part will be obvious from the description or can be learned by practice of the invention. The objectives and advantages are achieved by means of the processes, instrumentation and combinations particularly pointed out in the appended claims.

To achieve the foregoing objectives, the present invention provides a method for forming an anti-corrosive, oxide layer on steel, in which the steel surface is subjected to superheated steam for a period of at least one hour, and which comprises heating a cleaned steel surface in a nitrogen, air or oxygen atmosphere to at least 200° C., and then subjecting the heated steel to a further heating period in which a temperature between 450° C. and 520° C. is reached and maintained, with superheated steam under steam flow through conditions in which the steam flow is turbulent or should have a Reynolds number greater than 900.

It is to be understood that both the foregoing general description and the following detailed description are exemplary but are not restrictive of the invention.

DETAILED DESCRIPTION OF THE INVENTION

The steels treated in accordance with the process of the present invention are preferably maraging steels, but other steels can also be treated. Preferably the maraging steels contain the components Ni, Co, Mo and Ti in various proportions, which are dependent on the application. The alloying elements are not so important for the process itself; the determining factor is the application. The percentage range for the maraging steel components are:

Ni: 10–26,

Co: 6–18,

Mo: 2–12 and Ti: 0.5–2.0.

An example for another steel we have treated with air and water vapour is the steel 15Mo3 which has 0.15% carbon content and 0.39% molybdenum content.

The steels which are treated in accordance with the present invention are treated in their clean form. Generally, the steels are treated in their as-received, cleaned form from their manufacturer and before they have been subjected to corrosive media. Normal cleaning of the steels is only done if the surfaces are contaminated with oils, greases or other substances arising from the manufacturing process. On the other hand, if the steel is initially contaminated with easily oxidisable products, the initial heating process described below, is performed with air or oxygen only. Should the steel be contaminated with a thin oxide layer in the range 500–1000 Å, then the steel is heated to over 400° C. in an atmosphere of $N_2$ and $H_2$ (4 - 5 : 1) or in an atmosphere of $N_2$ and $NH_3$ (4 - 5 : 1). Normally oxide layers up to 500 Å need not be removed and so far we have not encountered initial oxide layers thicker than 1000 Å, from our manufacturers.

The clean steel surface is heated in a nitrogen, air or oxygen atmosphere to a temperature in the range of 200° C. - 250° C. The heating in the nitrogen, air, or oxygen atmosphere can bring the steel to a temperature from about 25° C. to 250° C. Generally, the steel is subjected to the nitrogen, air or oxygen treatment for a period of time from 20 min to 60 min. During this initial nitrogen, air or oxygen treatment, the steel is not subjected to superheated steam.

Upon reaching the desired temperature of over 200° C., the steel is then subjected to treatment with superheated steam. The superheated steam raises the temperature of the steel to the range of 450° to 520° C., generally in about 1 to 3 hours, and the steel is maintained by the superheated steam at this temperature. Preferably, the steel is maintained at a temperature of about 450° C. to 520° C. by the superheated steam for a period of from about 1 to 5 hours.

During the treatment with the superheated steam, the flow conditions should be as turbulent as possible. Generally, the Reynolds number of the flow must be at least 900 but the optimum range is from about 2100 to 2500.

After the steam treatment, the steel is cooled to about 100° C. by subjecting the steel, for several hours, to a stream of air having a temperature which can be adjusted in the range of 10° C. - 30° C. In the case where hydrogen or ammonia plus nitrogen were used for cleaning purposes, it is desirable to use nitrogen instead of air for the cooling down process. This prevents further oxidation of the oxide layer.

The entire process of the present invention, including the initial heating in nitrogen, air or oxygen, the superheated steam treatment, and the cooling, can take place in an accurately regulatable fluidized bed furnace. The steam used during the superheated steam treatment may have added to it nitrogen, air or oxygen in the ratios $H_2O : N_2$ or air or $O_2$ of no more than 4 : 1 or 5 : 1. The best results are obtained, however, with steam which is completely free of nitrogen, air or oxygen, respectively.

In the process of the present invention, a protective layer is formed which contains mixed oxides that are formed during the process and which are directly connected with the underlying base material by main valence bonding and hence produce excellent adhesion. The protective layer that is formed is a continuous, homogeneous, dense and nonporous protective layer which effectively prevents the diffusion of hydrogen and thus prevents possible hydrogen embrittlement.

With the process of the present invention, the corrosion rate on steel at 125° C. in a $UF_6$ atmosphere and low proportions of HF (0.1 to a maximum of 5 mol %) can be reduced at least by a factor of 50 compared to untreated surfaces. This means that, in a $UF_6$-HF atmosphere, the amount of uranium fluoride deposits that will be formed on steel surfaces becomes much lower. Thus, the efficiency and lifetime of $UF_6$ processing systems, particularly that of the rotors of gas ultracentrifuges, is no longer seriously impaired by corrosion. Moreover, any required uranium decontamination can either be completely eliminated or becomes much simpler.

Variation in the treatment periods permits adjustment of the thickness of the protective layer between 0.7 and 3 $\mu$. Thus, use of longer steam treatment periods produces thicker protective layers. Likewise, weld seams can be protected simultaneously with the process of the invention without any loss in quality.

In cases where ammonia was used to pretreat the steel surfaces the reaction time with steam was found to be much lower than with untreated steels and with steels treated with other gases, e.g. a layer thickness of 2.5 $\mu$ was already obtained in 90 minutes with steam, compared to the normal 5 hours.

The following example is given by way of illustration to further explain the principles of the invention. This example is merely illustrative and is not to be understood as limiting the scope and underlying principles of the invention in any way. All percentages referred to herein are by weight unless otherwise indicated.

EXAMPLE 1

A clean maraging steel sample (NiCoMo) was heated to 480° C. in an accurately regulatable fluidized bed furnace during a period of 60 minutes. In this 60-minute period, the heating initially took place in air to bring the steel to a temperature of 200° C. (20 minutes) and upon reaching 200° C., heating then took place with 21 $Nm^3/h$ superheated steam (Re = 2100) to bring the heated steel to a temperature of 480° C. This steam treatment was continued for 3 hours at 480° C. Thereafter, the steel was cooled to 100° C. in a stream of air of grater than 20 $Nm^3/h$ during a period of time of about 3 hours. A microcrystalline firmly adhering mixed oxide layer was formed which had a thickness of about 1$\mu$, and which consisted of mixed and pure spinels of the type $Fe(Fe_2O_4)$, $Ni(Fe_2O_4)$, $Ni(Co_2O_4)$, $Co(Co_2O_4)$, and $FeMoO_4$, with an average lattice constant of 8.4 Å. The mechanical properties of the heated sample, such as tensile strength, modulus of elasticity and coefficient of expansion, remained fully unchanged. The $H_2$ content of the treated sample was less than 1 ppm. A number of steel samples were treated in a similar manner, and the $H_2$ content of the treated samples was always less than 1 ppm.

It will be understood that the above description of the present invention is susceptible to various modifications, changes and adaptations, and the same are intended to be comprehended within the meaning and range of equivalents of the appended claims.

What is claimed is:

1. In a process for forming an anti-corrosive oxide layer on maraging steel, in which the steel surface is subjected to superheated steam for a period of at least one hour, the improvement comprising heating a clean maraging steel surface to a temperature between 200° C. and 250° C. in a nitrogen, air or oxygen atmosphere in the absence of superheated steam, and then subjecting the heated maraging steel to a further heating period in which a temperature between 450° C. and 520° C. is reached and maintained, with superheated steam under flow conditions in which the flow has a Reynolds number of greater than 900 to form an anti-corrosive oxide layer which is a mixed oxide layer.

2. The method as defined in claim 1 wherein, after the steam treatment the steel is cooled for several hours in a stream of nitrogen or air with regulatable temperature.

3. The method as defined in claim 2 wherein the steel is cooled to a temperature of about 100° C.

4. The method as defined in claim 2 wherein the heating and cooling are effected in a regulatable fluidized bed furnace.

5. The method as defined in claim 1 wherein the heating is effected in a regulatable fluidized bed furnace.

6. The method as defined in claim 1 wherein the superheated steam flow is as turbulent as possible.

7. The method as defined in claim 1 wherein the Reynolds number is from about 2100 to 2500.

8. The method as defined in claim 1 wherein the oxide layer comprises mixed and pure spinels of $Fe(Fe_2O_4)$, $Ni(Fe_2O_4)$, $Ni(Co_2O_4)$, $Co(Co_2O_4)$ and $FeMoO_4$.

* * * * *